US010674784B2

(12) United States Patent
Theoklitos et al.

(10) Patent No.: US 10,674,784 B2
(45) Date of Patent: Jun. 9, 2020

(54) FOOTWEAR FOR PLAYING FOOTBALL

(71) Applicant: Concave Global Pty Ltd, Richmond, Victoria (AU)

(72) Inventors: Andrew Theoklitos, Richmond (AU); Andrew Neophitou, Richmond (AU)

(73) Assignee: Concave Global Pty Ltd, Richmond, VIC (AU)

( * ) Notice: Subject to any disclaimer, the term of this patent is extended or adjusted under 35 U.S.C. 154(b) by 524 days.

(21) Appl. No.: 14/891,307

(22) PCT Filed: May 15, 2014

(86) PCT No.: PCT/AU2014/050040

§ 371 (c)(1),
(2) Date: Nov. 13, 2015

(87) PCT Pub. No.: WO2014/183170

PCT Pub. Date: Nov. 20, 2014

(65) Prior Publication Data

US 2016/0081419 A1 Mar. 24, 2016

(30) Foreign Application Priority Data

May 15, 2013 (AU) ..... 2013901726

(51) Int. Cl.
*A43B 5/02* (2006.01)
*A43B 23/26* (2006.01)
*A43B 23/02* (2006.01)

(52) U.S. Cl.
CPC ..... *A43B 5/025* (2013.01); *A43B 23/0245* (2013.01); *A43B 23/26* (2013.01)

(58) Field of Classification Search
CPC ..... A43B 5/025; A43B 23/0245; A43B 23/26
(Continued)

(56) References Cited

U.S. PATENT DOCUMENTS 155,968 A * 10/1874 Owens ..... A43B 3/0031 36/1
3,525,165 A * 8/1970 Randall, Jr. ..... A43B 5/02 36/128

(Continued)

FOREIGN PATENT DOCUMENTS

| | | | |
|---|---|---|---|
| AU | 346884 | S | 2/2013 |
| DE | 87 00 439 | U1 | 8/1987 |
| EP | 0958753 | A2 | 11/1999 |

OTHER PUBLICATIONS

Concave Football, "How to Lace Up Your Concave Boots," <http://www.youtube.com/watch?v=0kKdHyXIt10> [originally retrieved Jul. 7, 2014], Jan. 8, 2013, 21 pages of screenshots [retrieved Nov. 13, 2013].

(Continued)

*Primary Examiner* — Anne M Kozak
(74) *Attorney, Agent, or Firm* — Christensen O'Connor Johnson Kindness, PLLC

(57) ABSTRACT

A football shoe or boot including a sole (12), an upper (14) and a tongue (16), wherein the upper includes a flap (22) that overlies the tongue and at its lateral edges (33) is separated from side portions (15) of the upper by respective slits (25) open at their rear ends (26) and closed at their forward ends (27). The flap has an upper surface (23) that includes a ball control region (30). In one aspect the ball control region extends rearwardly from a foremost extremity located rearwardly of the forward ends of said slits. In another aspect, the slits are provided with lacing (60) whereby, when the shoe or boot is being worn, the relative positions of said lateral edges and the opposed side portions of the upper may be controlled.

11 Claims, 7 Drawing Sheets

(58) Field of Classification Search
USPC ..... 36/128
See application file for complete search history.

(56) References Cited

U.S. PATENT DOCUMENTS

| | | | | |
|---|---|---|---|---|
| 3,703,775 | A | 11/1972 | Gatti | |
| 5,701,688 | A * | 12/1997 | Crowley | A43B 23/26 36/101 |
| 6,421,936 | B1 | 7/2002 | Gerrand | |
| 7,331,128 | B1 * | 2/2008 | Navasky | A43B 3/24 36/101 |
| D644,018 | S * | 8/2011 | Kass | D2/912 |
| 8,484,865 | B2 * | 7/2013 | Baker | A43B 5/02 36/133 |
| 2002/0029496 | A1 * | 3/2002 | Morle | A43B 5/02 36/99 |
| 2005/0144812 | A1 * | 7/2005 | Wheeler | A43B 3/0078 36/133 |
| 2009/0044427 | A1 | 2/2009 | Shepherd et al. | |
| 2009/0100712 | A1 | 4/2009 | Baker | |

OTHER PUBLICATIONS

International Search Report and Written Opinion dated Jul. 16, 2014, issued in corresponding International Application No. PCT/AU2014/050040, filed May 15, 2014, 10 pages.

* cited by examiner

FOOTWEAR FOR PLAYING FOOTBALL

FIELD OF THE INVENTION

This invention relates generally to footwear worn when playing football. The invention is suitable for all codes including soccer, rugby, and Australian, American and Gaelic football but is especially useful when playing what is known in most countries as football and distinguished in others as soccer.

BACKGROUND OF THE INVENTION

There have been a number of proposals over time for football shoes or boots with uppers to enhance the outcome of kicking a ball. For example, U.S. Pat. No. 6,421,936 discloses a football shoe having an upper with an instep defined by a pair of longitudinally extending spaced apart ridges laterally of a transversally concave surface for substantially cupping a ball that contacts the instep. The upper further has a toe region and the ridges have, at their front ends behind the toe region, front surfaces with respective upper peaks.

The broad concept of a concave ball contacting surface is also disclosed in European patent 359081, in which a pair of ridges are disposed along the sides of the lace region, and in European patent 496931 in which the concave surface extends from a planar shoe tip almost to the ankle opening. International patent publication WO096122712 describes a soccer shoe in which a mix of external leather patches and ribs in the toe region are thought to give the player a more accurate control of the ball during kicking.

With the configuration of U.S. Pat. No. 6,421,936, objective tests have established that the modified upper increases the departure velocity of the ball when all other factors are substantially equal, and subjective player experience is that the configuration increases kicking accuracy. Both these benefits are clearly valuable when kicking for goal in soccer and other football codes. However, player experience is that football shoes with modified uppers of the kinds disclosed in the aforementioned patents can be less comfortable than unmodified shoes, especially when running down the ground, because of reduced flexibility in the upper. This was a reason why the modified region is set back behind the toe region in embodiments described in U.S. Pat. No. 6,421,936, and in a commercial shoe made pursuant to that patent and marketed under the brand Concave™. While these shoes have been found beneficial for their improved kicking accuracy and ball speed, players have suggested that comfort might be improved during running, and have also expressed some concern about the additional weight of the shoe arising from the inserted material to achieve the modified upper configuration.

It is an object of the invention to at least in part address these concerns.

Reference to any prior art in the specification is not, and should not be taken as, an acknowledgment or any form of suggestion that, this prior art forms part of the common general knowledge in Australia or any other jurisdiction or that this prior art could reasonably be expected to be ascertained, understood and regarded as relevant by a person skilled in the art.

SUMMARY OF THE INVENTION

It has been realised, in accordance with the invention, that it is possible to address concerns about comfort and weight and still achieve enhanced ball kicking if the overall length of the modified region of the upper is reduced and confined within a flap of the upper that overlies the tongue of the shoe. In an alternative or supplementary approach, an acceptable outcome can be obtained by providing the concave region at least in part in a flap overlying the tongue, with the flap location controlled by lacing between opposed lateral edges of the flap and the upper.

The invention accordingly provides, in a first aspect, a football shoe or boot including a sole, an upper and a tongue, wherein the upper includes a flap that overlies the tongue and at its lateral edges is separated from side portions, of the upper by respective slits open at their rear ends and closed at their forward ends, and wherein the flap has an upper surface that includes a ball control region that extends rearwardly preferably substantially rearwardly from a foremost extremity located rearwardly of said forward ends of said slits.

Preferably, said slits are provided with lacing by which, when the football shoe or boot is being worn, the relative positions of said lateral edges of the flap and the opposed side portions of the upper may be controlled.

In a second aspect, the invention provides a football shoe or boot including a sole, an upper and tongue, wherein the upper includes a flap that overlies the tongue and at its lateral edges is separated from side portions of the upper by respective slits open at their rear ends and closed at their forward ends, which flap has an upper surface that includes a ball control region, and wherein said slits are provided with lacing whereby, when the shoe or boot is being worn, the relative positions of said lateral edges and the opposed side portions of the upper may be controlled.

Advantageously, in both aspects, the ball control region comprises a transversely curved surface between respective lateral ridge portions Preferably, said ridge portions are tapered rear to front so that the concave surface and the ridge portions substantially merge into a surface region of the upper in front of the ball control region.

Advantageously, the lower edges of the ridge portions are set back from the said lateral edges of the flap.

Preferably, the tongue extends further rearwardly than the flap and in addition advantageously provides cushioning between the rear edge of the flap and the wearer's ankle. The rear edge of the flap may be finished with an end piece that avoids a stitching edge that may irritate the wearer's skin.

Advantageously, the length of each slit is 40 to 60 percent of the length dimension from the rear of the flap to the toe of the shoe or boot.

The flap may be an integral separate piece stitched or otherwise fastened to a surrounding piece of the upper that includes said side portions and also a toe region in front of the flap.

Preferably, the upper including the flap apart from the ball control region comprises highly flexible material for the wearer's optimum comfort, whereas the ball control region may typically include relatively more rigid material for defining the ridge portions and transversely curved surface and imparting greater velocity to a ball kicked by contact with the upper including the ball control region.

The aforementioned lacing may typically extend between plural eyes or apertures at the lateral edges of the flap and in the side portions of the upper. The laces may emerge to the outside of the upper for finger manipulation, through respective apertures in the side portions of the uppers adjacent the rear end of the flap.

As used herein, except where the context requires otherwise the term 'comprise' and variations of the term, such as 'comprising', 'comprises' and 'comprised', are not intended to exclude other additives, components, integers or steps.

BRIEF DESCRIPTION OF THE DRAWINGS

The invention will now be further described, by way of example only, with reference to the accompanying drawings, in which.

DETAILED DESCRIPTION OF THE EMBODIMENTS

Figure 1:
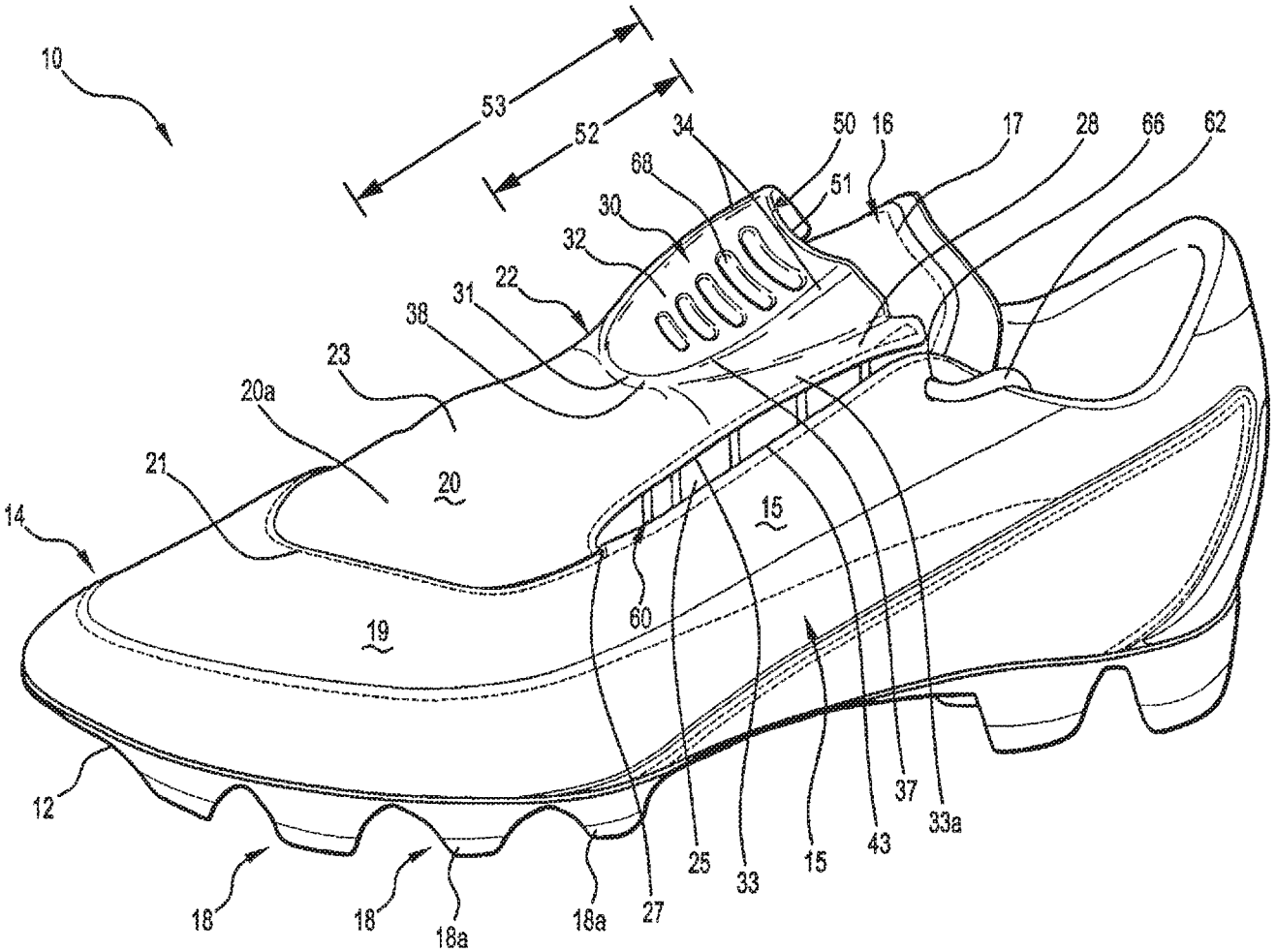
FIG. 1 is a front outer side perspective view of a left foot football shoe according to an embodiment of the invention.

The illustrated embodiment of football shoe 10 is designed especially for playing the form of football also known in some countries as soccer. It includes a sole 12, an upper 14 and a tongue 16. The sole 12 is provided in a known fashion with an array of studs 18 having aluminum tips 18*a*. The sole and upper are made and assembled by known techniques.

In accordance with a preferred embodiment of the invention, upper 14, which is fashioned in a suitable highly flexible leather or polymer material, includes a separate central piece 20 that defines a flap 22 overlying most of tongue 16 apart from a rear most portion 17. Flap 22 is separated at its lateral edges 33 from side portions 15 of upper 14 by respective slits 25 open at their rear ends 26 (FIG. 2) and closed at their forward ends 27. The portion 20*a* of upper piece 20 forwardly of flap 22 extends some distance towards the toe and is sewn at its periphery 21 to a surrounding panel 19 of the upper that includes side portions 15.

Figure 7:
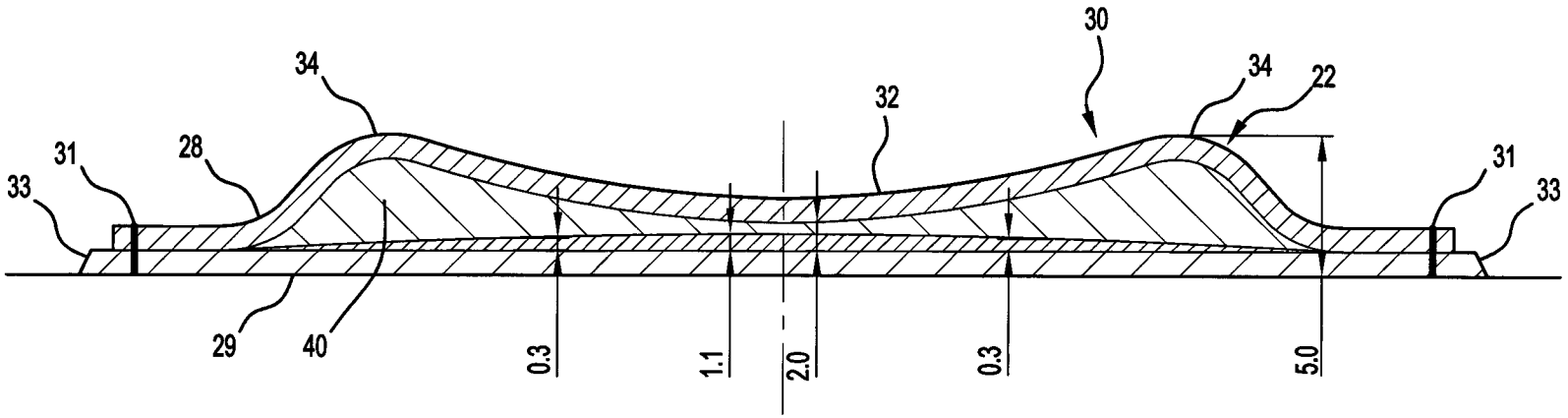
FIG. 7 is a fragmentary cross-section on the line 7-7 in FIG. 2.

Disposed centrally and in the rear of the upper surface 23 of flap 22 is a ball control region 30. This region 30 extends rearwardly from a foremost extremity 31 located rearwardly of, preferably substantially rearwardly of, the closed forward ends 27 of slits 25, and is defined by an insert 40 (FIG. 7) of substantially rigid material retained by adhesive between top and bottom layers 28, 29 of flap 22. Bottom layer 29 is retained by adhesive to the insert and by stitching 33*a* at lateral edges 33 of the flap 22.

Figure 2:
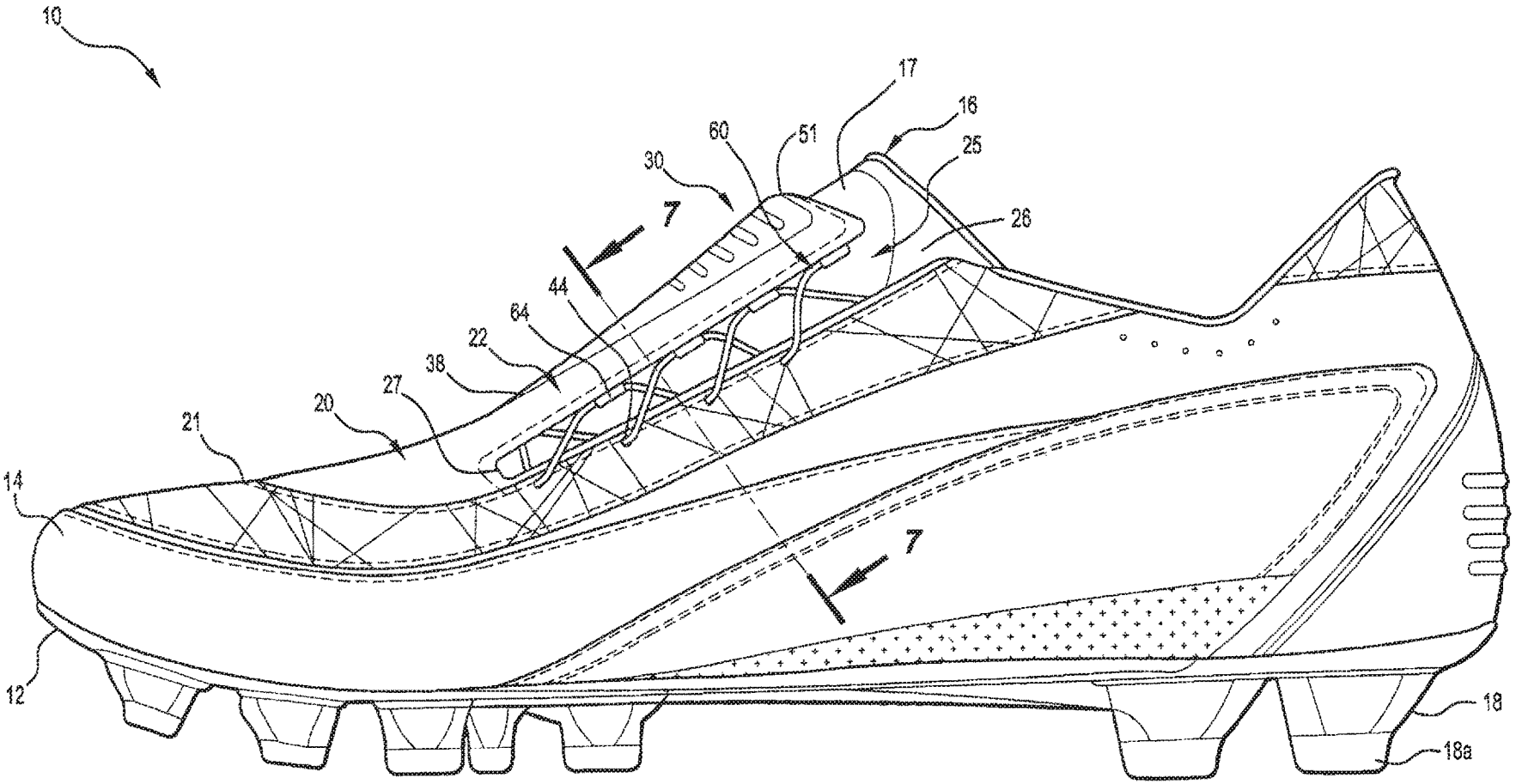
FIGS. 2 and 3 are respective outer and inner side elevations, with some minor differences relative to FIG. 1.

Ball control region 30 exhibits a transversely curved or concave surface 32 between respective lateral ridge portions 34. Both surface 32 and ridge portions 34 taper downwardly from the rear to forward extremities 31, 37 located rearwardly of the closed forward ends 27 of slits 25. As shown in FIGS. 1 and 2, surface 32 and ridge portions 34 substantially merge into the forward portion of smooth upper surface 23 of flap 22 but for a shallow continuously or partially curved shoulder 38 linking ridge portions 34 to define the foremost extremities of the ridges and of surface 32. Concave surface 32 has spaced shallow transverse grooves or channels 68.

It will be observed that the longitudinal extent of slits 25 is about half the length dimension from the rear of flap 22 to the front tip of the shoe (and is preferably 40 to 60% thereof), and that the central longitudinal extent 52 of ball control region 30 is preferably 70 to 75 percent of the longitudinal distance 53 from the centre top 51 of the ball control region 30 to the line joining the front ends 27 of slits 25. In general, this latter proportion is preferably in the range 50 to 90%, more preferably 60 to 80%.

Figure 3:
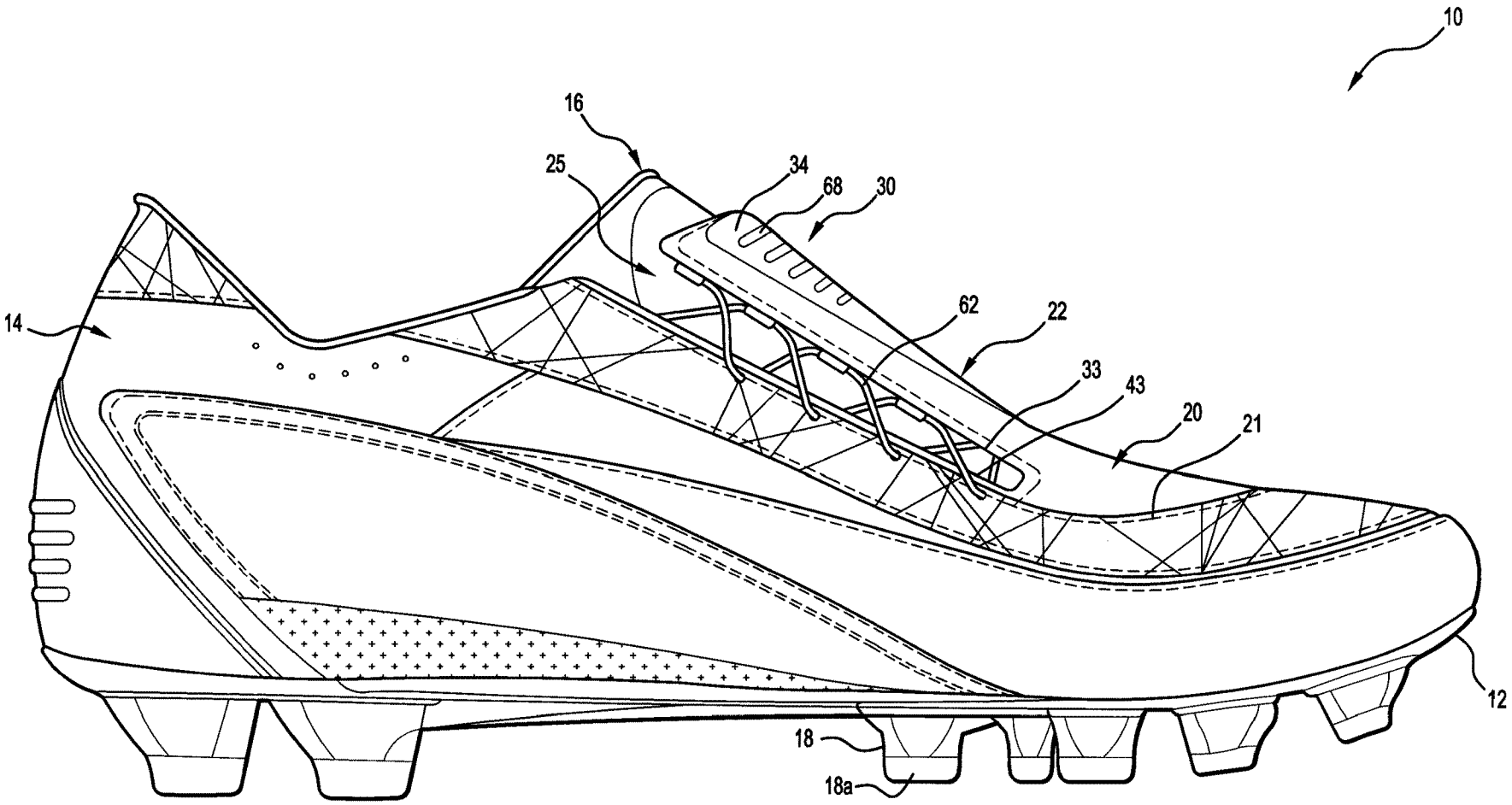
Figure 4:
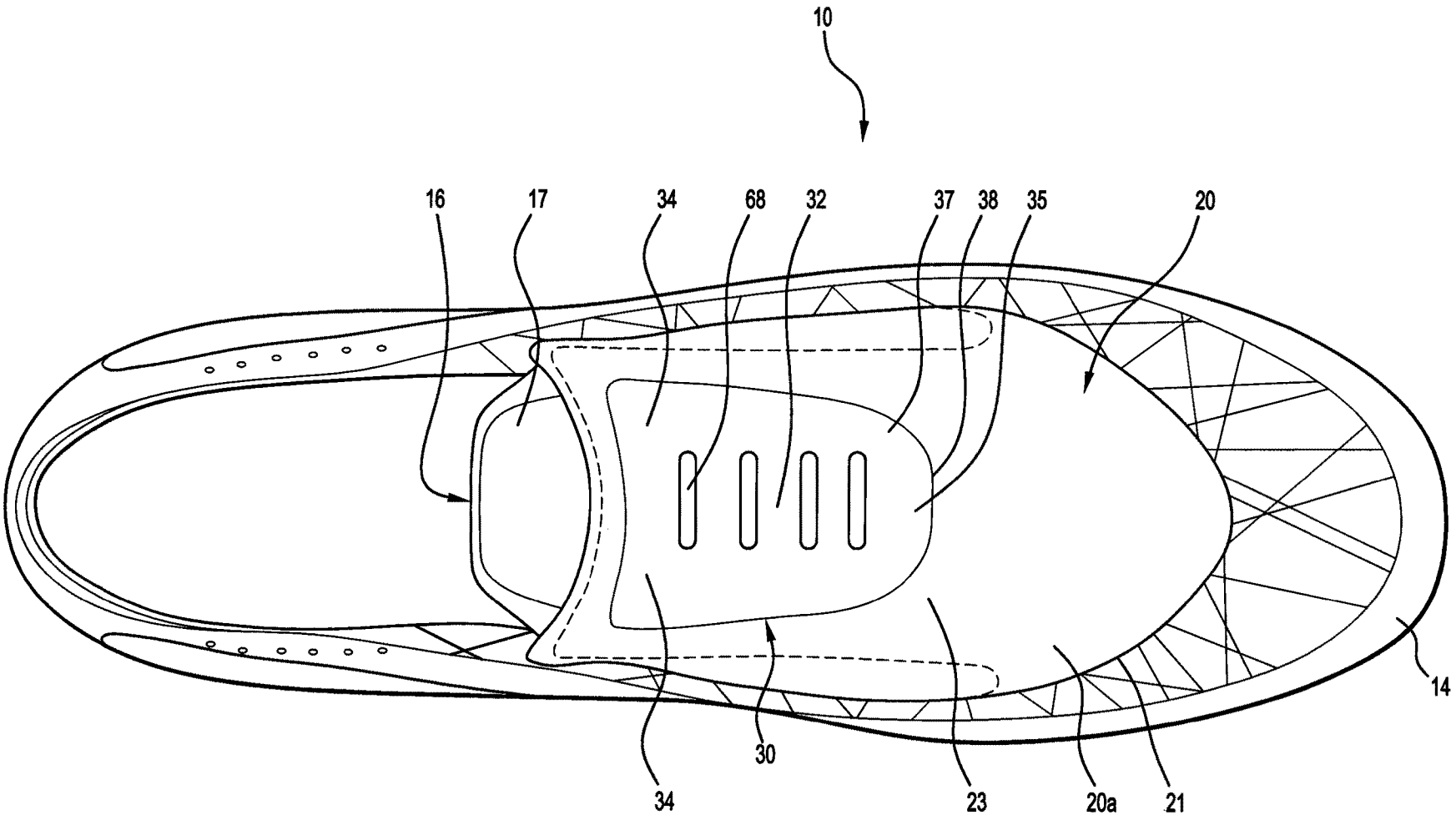
FIGS. 4 to 6 are respectively a plain view, an underneath view and a rear view of the shoe shown in FIGS. 2 and 3.
Figure 5:
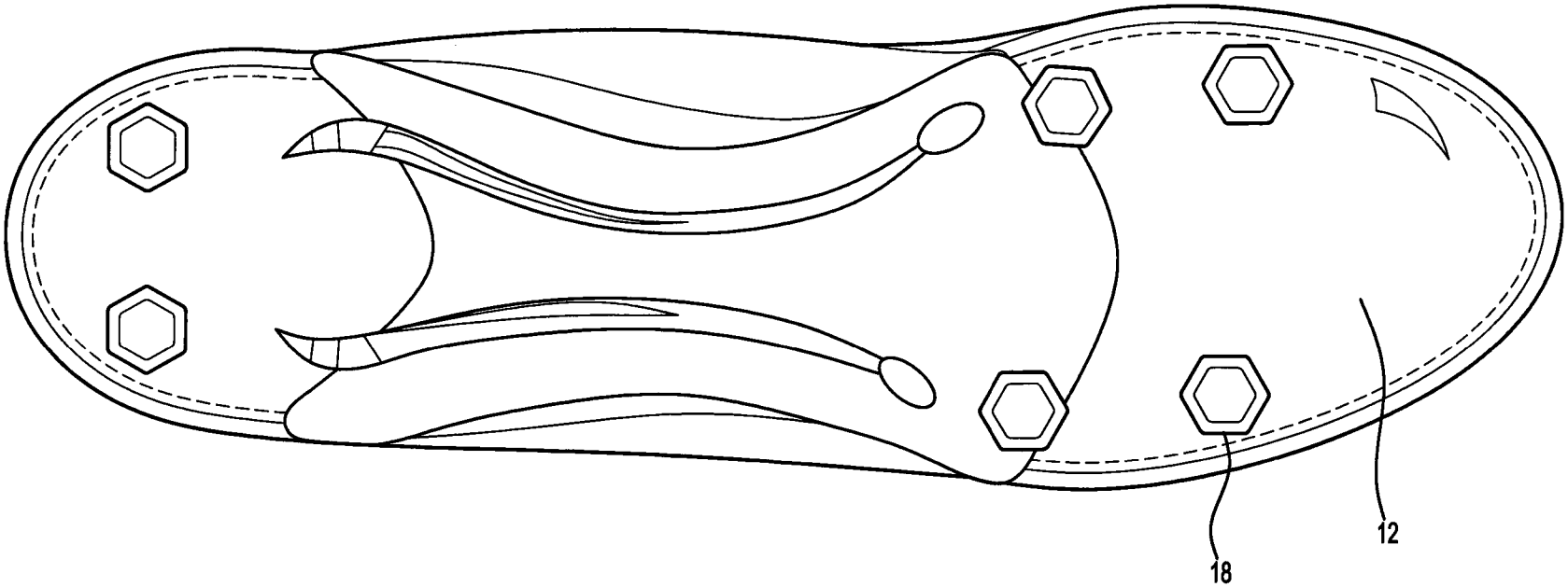
Figure 6:
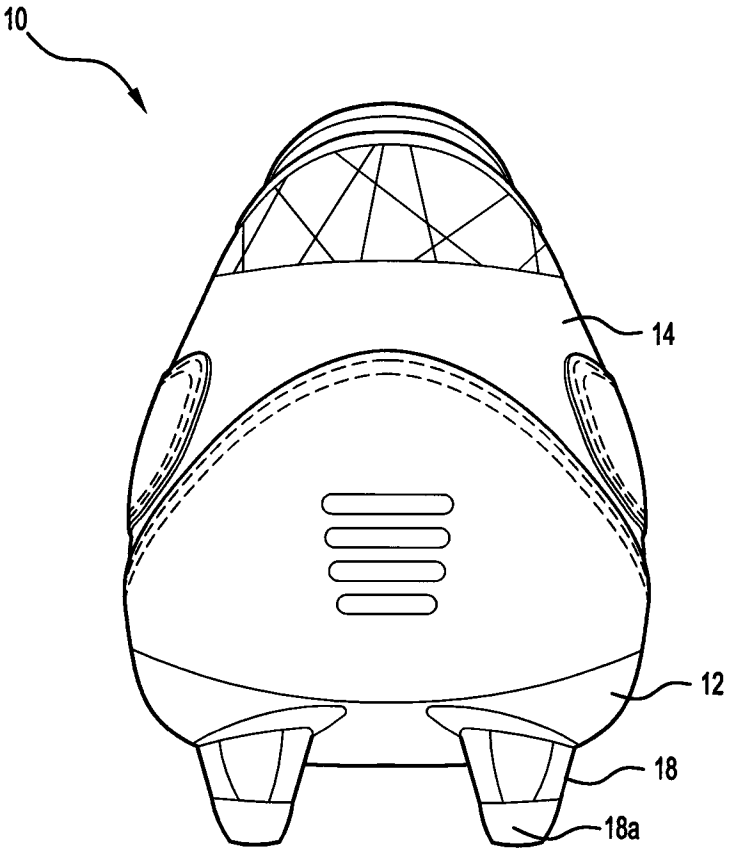

At the rear of flap 22, the bottom side edges of ridge portions 34 are set back from the lateral edges 33 of the flap. The rear end of the ball control region 30 may be defined by a stitched edge (as in FIGS. 2 and 3) or by a shaped end plate 50 (as in FIG. 1). The latter is preferred in order to minimise irritation to the wearers leg, and it will be observed that this potential problem is also guarded against by having the tongue 16 extend further rearwardly than the flap 22.

The lateral edges 33 of flap 22 and the opposed edge 43 of side portions 15 that define the slits 25 are stitched and beaded for reinforcement and linked by lacing 60. The lace or laces 62 are retained in sewn-in eyes or sleeves 64 (FIG. 2) on the under surface of flap 22 and either similar elements on upper side portions 15 (as in FIG. 1) or apertures 44 in the side portions 15 (as in FIGS. 2 and 3). There may be a single lace which also crosses between the sides of the shoe under the flap or there may be separate laces each side, fixed at an inner end. In either case, the laces 62 emerge to the exterior of the shoe through respective apertures 66 in the upper side portions 15 adjacent the rear end of the flap (or through interior eyes or sleeve portions, or otherwise).

The lace or laces 62 are manipulated to comfortably secure the shoe on the wearer's foot by closing the slits 25 to the appropriate extent, i.e. by controlling the relative positions of lateral edges 33 of the flap and opposed edges 43 of upper side portions 15.

With the illustrated shoe configuration, the retraction, relative to prior shoes, of the ball control region with its curved or concave surface towards the ankle of the wearer, and in the illustrated embodiment into a region of the flap, retains the advantageous feature of a surface that substantially cups a ball as it is kicked and improves the accuracy and velocity of the kick, while leaving the majority of the upper instep with a level of flexibility that ensures comfort, especially when the wearer is running. At the same time, the smaller size of the insert defining the ball control region by means of substantially solid material assists in lightening the overall weight of the shoe.

The invention claimed is:

1. A football shoe or boot including a sole, an upper and a tongue, wherein the upper includes a flap that overlies the tongue and at its lateral edges is separated from side portions of the upper by respective slits open at their rear ends and closed at their forward ends, and wherein the flap has an upper surface that includes a ball control region which extends rearwardly from a foremost extremity located rearwardly of said forward ends of said slits, such that a central longitudinal extent of the ball control region from the foremost extremity to a rearmost centre top portion of the ball control region, is 50 to 90% of the longitudinal distance from the rearmost centre top portion of the ball control region to a line joining said forward ends of said slits, and wherein the ball control region comprises lateral ridge portions extending longitudinally on either side of the flap and a transversely curved surface extending between said lateral ridge portions, which are tapered downwardly in height rear to front so that the transversely curved surface and the lateral ridge portions merge into a smooth surface region of the flap in front of the ball control region.

2. The football shoe or boot according to claim 1, wherein said slits are provided with lacing by which, when the football shoe or boot is being worn, the relative positions of said lateral edges of the flap and the side portions of the upper may be controlled.

3. The football shoe or boot according to claim 2, wherein the lacing extends between plural eyes or apertures at the lateral edges of the flap and in the side portions of the upper.

4. The football shoe or boot according to claim 2, wherein the lacing includes one or more laces that emerge to the outside of the upper for finger manipulation, through respective apertures in the side portions of the upper adjacent a rear end of the flap.

5. The football shoe or boot according to claim 1, wherein the upper including the flap apart from the ball control region comprises flexible material for the wearer's comfort, wherein the ball control region includes relatively more rigid material defining the ridge portions and transversely curved surface and imparting greater velocity to a ball kicked by contact with the upper including the ball control region.

6. The football shoe or boot according to claim 1, wherein the tongue extends further rearwardly than the flap to provide cushioning between a rear edge of the flap and the wearer's ankle.

7. The football shoe or boot according to claim 1, wherein the length of each said slit is 40 to 60 percent of the length dimension from a rear of the flap to a toe of the shoe or boot.

8. The football shoe or boot according to claim 1, wherein the flap is a separate piece stitched or otherwise fastened to a surrounding piece of the upper that includes said side portions and also a toe region in front of the flap.

9. The football shoe or boot according to claim 1, wherein the central longitudinal extent of the ball control region is 60 to 80% of the longitudinal distance from a centre top of the ball control region to a line joining the front ends of said slits.

10. The football shoe or boot according to claim 1, wherein the central longitudinal extent of the ball control region is 70 to 75% of the longitudinal distance from a centre top of the ball control region to a line joining the front ends of said slits.

11. The football shoe or boot according to claim 1, wherein the transversely curved surface extending between the lateral ridge portions is concave toward the tongue.

* * * * *